United States Patent [19]

Suverison et al.

[11] 4,043,630

[45] Aug. 23, 1977

[54] MOLDED ELECTRICAL CONNECTOR

[75] Inventors: Lyle B. Suverison, Fowler; William R. Beck, Warren, both of Ohio

[73] Assignee: General Motors Corporation, Detroit, Mich.

[21] Appl. No.: 730,932

[22] Filed: Oct. 8, 1976

[51] Int. Cl.[2] ..... H01R 13/58

[52] U.S. Cl. ..... 339/218 M; 339/63 M; 339/102 R

[58] Field of Search ..... 339/63, 102, 103, 218

[56] References Cited

U.S. PATENT DOCUMENTS

| | | | |
|---|---|---|---|
| 1,974,790 | 9/1934 | Barth | 339/63 R |
| 3,086,251 | 4/1963 | Bernat | 339/218 M |
| 3,609,630 | 9/1971 | Francis | 339/218 R |
| 3,945,708 | 3/1976 | Griffin | 339/218 R |

FOREIGN PATENT DOCUMENTS

| | | | |
|---|---|---|---|
| 711,341 | 6/1965 | Canada | 339/218 M |

*Primary Examiner*—Roy Lake
*Assistant Examiner*—Mark S. Bicks
*Attorney, Agent, or Firm*—F. J. Fodale

[57] ABSTRACT

A molded electrical connector comprises a preformed insert of stiff plastic material. The insert retains and spaces cylindrical female terminals connected to conductor cores of separated leads of a multilead cable while a molded body of pliable insulation material is molded thereabout. The insert has an exposed face plate portion with an index slot and conical guide surfaces for the apertures leading to female terminals.

6 Claims, 7 Drawing Figures

MOLDED ELECTRICAL CONNECTOR

This invention relates generally to electrical connectors and more specifically to molded electrical connectors formed by molding a body of insulating material about a plurality of spaced electrical terminals attached to the bared conductor core ends of a multilead electrical cable.

It is already known from the U.S. Pat. No. 3,609,630 granted to Wallace R. Francis on Sept. 28, 1971 for a "Double Insulated Plug" to incorporate a performed insert in molded connectors to space the terminals and the bared conductor core ends during the molding operation.

In its broadest sense, the object of this invention is to provide an improved molded connector as well as an improved preformed insert therefor.

Another object of this invention is to provide an improved preformed insert which retains the terminals to facilitate the molding operation.

Another object of this invention is to provide an improved preformed insert which laterally receives the terminals and strongly retains the terminals against terminal pushout in the longitudinal direction during the molding operation.

Another object of this invention is to provide an improved preformed insert which retains the terminals in their proper position prior to the final molding operation so that an electrical check can be made prior to the final molding operation.

Yet another object of this invention is to provide an improved preformed insert which may include portions for spacing the separated individually insulated leads of a multilead cable.

Yet another object of this invention is to provide a molded connector having a preformed insert of relatively rigid material having portions thereof exposed for providing index means and terminal guide means.

Figure 1:
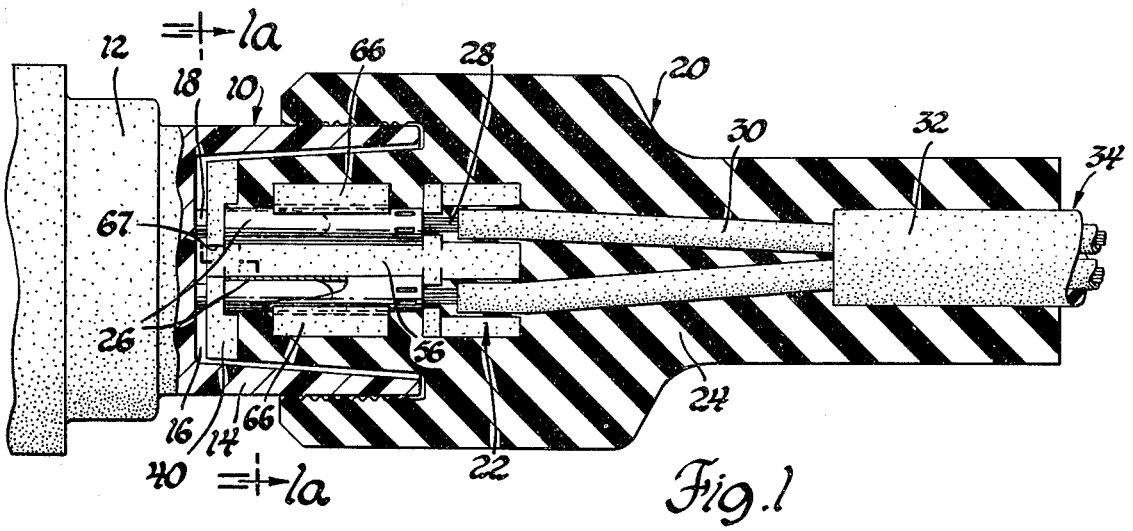
Figure 2:
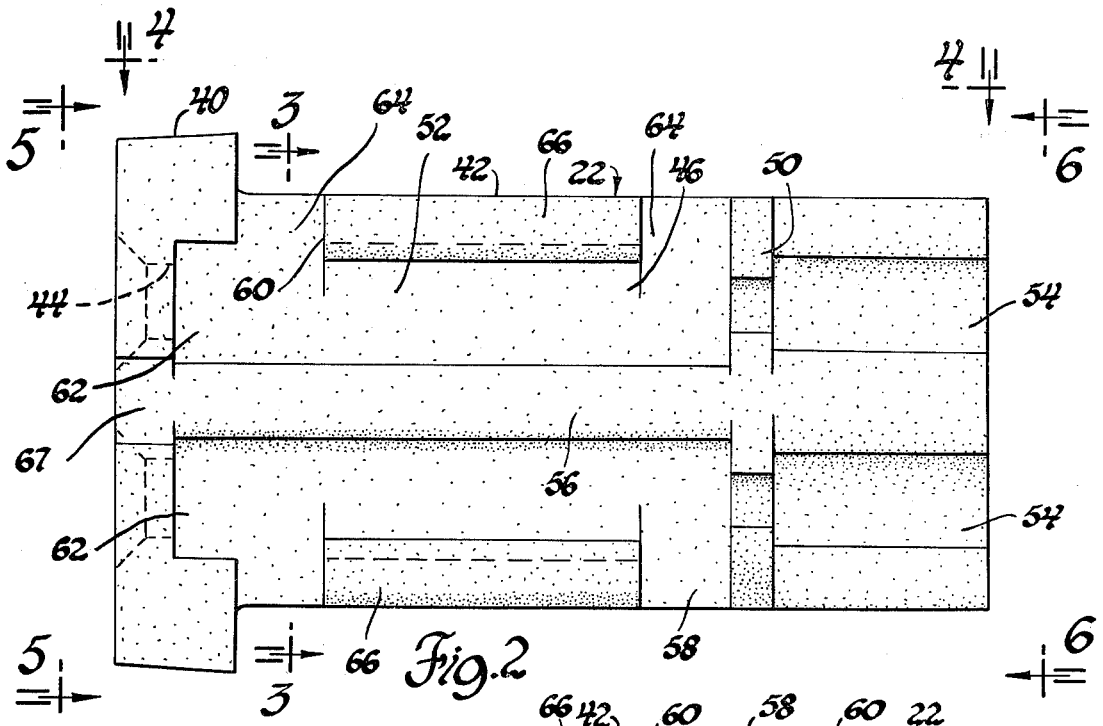
Figure 1A:
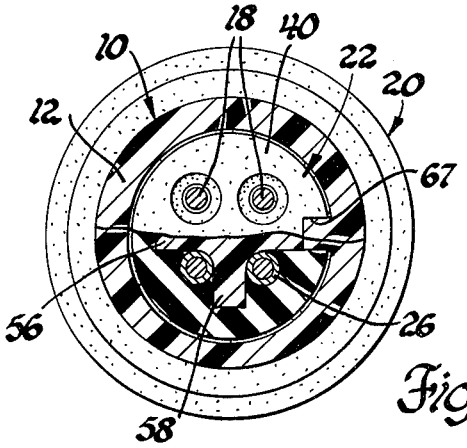
Figure 3:
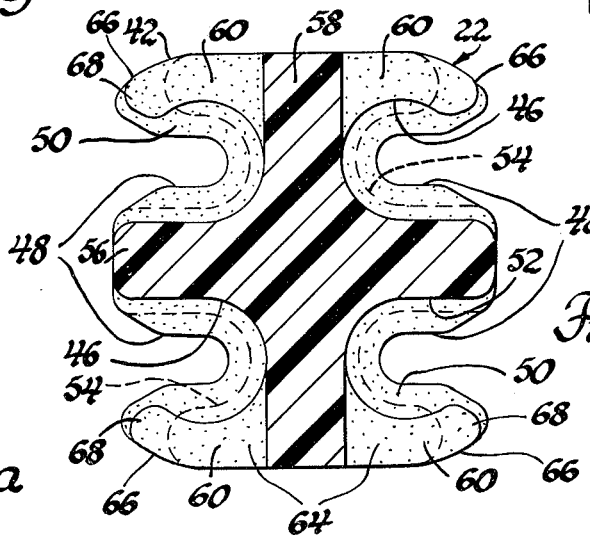
Figure 4:
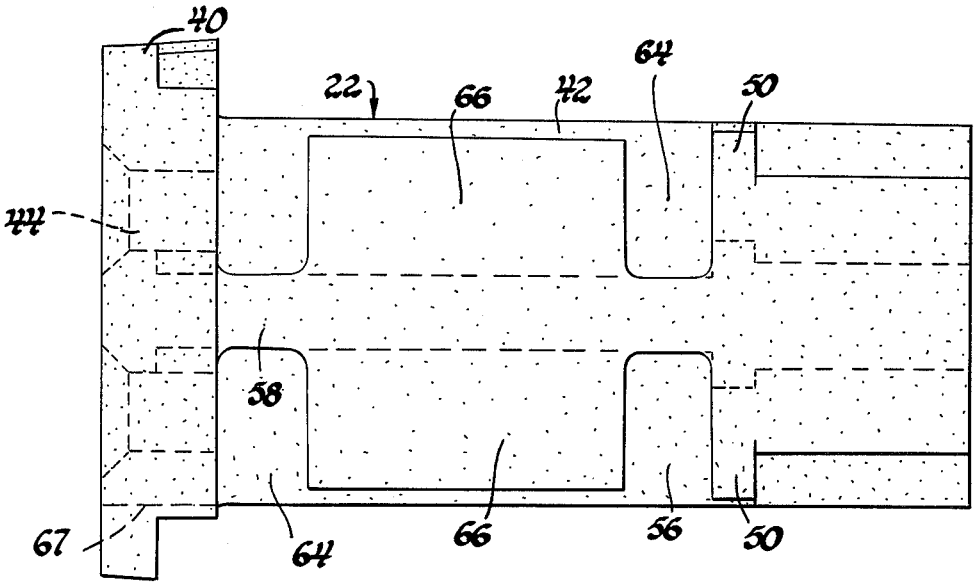

Still another object of this invention is to provide a molded connector using a rigid plastic insert with an exposed face plate for indexing thereby facilitating the use of inherently pliable materials such as thermoplastic rubber which match the material of cable jacket and thus can be hermetically sealed to the cable jacket as a result of the molding operation. Other objects and features of the invention will become apparent to those skilled in the art as the disclosure is made in the following detailed description of a preferred embodiment of the invention as illustrated in the accompanying sheets of drawing in which:

FIG. 1 is a longitudinal section through a pair of mated electrical connectors which includes a female connector made in accordance with this invention, FIG. 1*a* is a section taken along the line 1*a* —1*a* of FIG. 2 looking in the direction of the arrows, FIG. 2 is an enlarged view of the preformed insert for the connector shown in FIG. 1, FIG. 3 is a section taken along the line 3—3 of FIG. 2 looking in the direction of the arrows, FIG. 4 is a top view of the preformed insert shown in FIG. 1 taken along the line 4—4 looking in the direction of the arrows.

Figure 5:
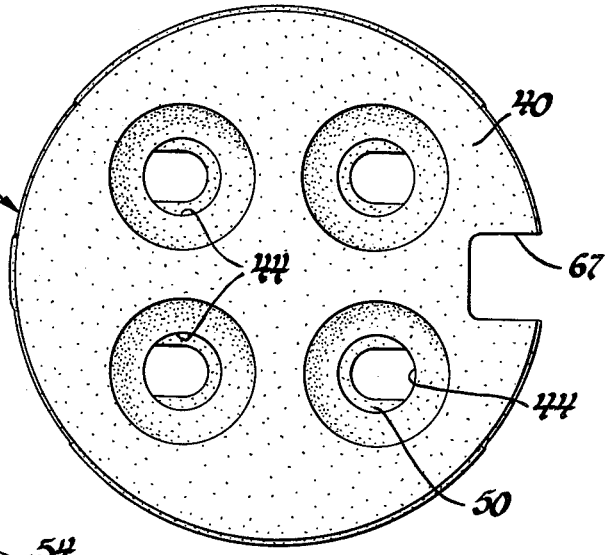
Figure 6:
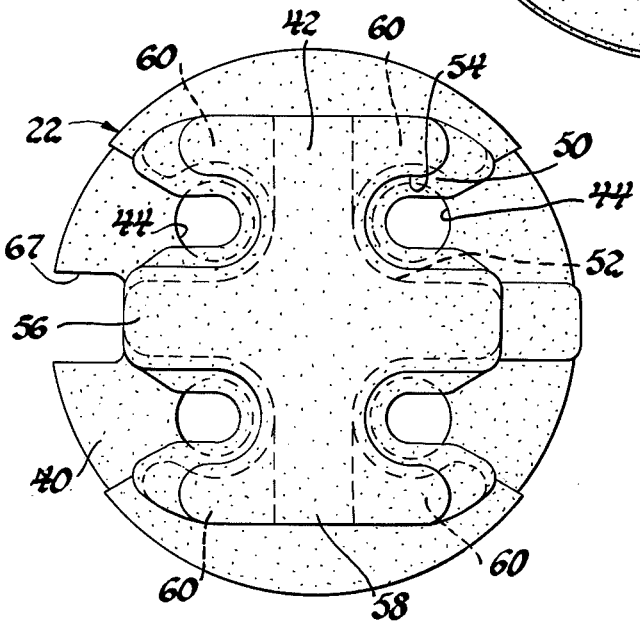

FIG. 5 is a section taken along the line 5—5 of FIG. 2 looking in the direction of the arrows, and FIG. 6 is a section taken along the line 6—6 of FIG. 2 looking in the direction of the arrows.

Referring now to the drawing and particularly FIG. 1, there is shown a pair of engaged electrical connectors 10 and 20. The male connector 10 is conventional and comprises a nonconductive connector body 12 having a protruding annular lip 14 forming a central cavity 16 in which are disposed four protruding male terminals 18.

The female electrical connector 20 is a molded type connector in accordance with this invention comprising a preformed insert 22 of a relatively stiff moldable insulating material such as nylon or other synthetic plastic embedded in a molded body 24 of pliable insulating material such as a synthetic thermoplastic rubber. The preformed insert 22 retains a plurality of cylindrical female terminals 26 attached to the stripped conductor core ends 28 of the separated leads 30 in the proper spaced relationship while the molded body 24 is molded about the insert 22, the separated leads 30 and the end portion of the common insulator jacket 32 of the multilead cable 34 adjacent the separated leads 30.

The preformed insert 22 is shown in detail in FIGS. 2 through 6 and comprises a front plate 40 and a normally disposed elongated turret 42 trailing from the rearward face of the plate 40. The front plate 40 has four spaced apertures 44 which each align with one of four spaced channels 46 in the elongated turret 42. The channels 46 extend for the entire length of the turret 42 and each has a lateral opening 48 which also extends for the entire length of the turret 42. Each of the channels 46 are divided by a transverse yoke wall 50 which separates the channel into a forward terminal receiving portion 52 and a rearward insulated lead receiving portion 54.

As best seen in FIG. 3 the elongated turret 42 comprises longitudinally extending walls 56 and 58 which are orthogonally related. At each end of the wall 58 there are a pair of longitudinal walls 60 which are generally parallel to the wall 56. Each of the channels 46 are defined by portions of the walls 56, 58 and one of the four longitudinal walls 60. The walls 56 and 58 which separate the channels longitudinally are continuous from the front plate 40 to the rear or remote end of the turret 42 and are relatively thick and stiff. On the other end the four walls 60 which are each associated with a single channel are segmented by pairs of longitudinally spaced transverse slots 64 which provide a resiliently deflectable wall 66 partially defining the terminal receiving portion 52 of each channel 46. Each of the resiliently deflectable walls 66 has a curled in retaining lip 68 at the free end. The face plate 40 also has four transverse rear slots 62 aligned with the terminal receiving portions of the channels 46 and a radial indexing slot 67 aligned with the wall 56. The forward portions of the apertures 44 are conical guide surfaces.

From FIGS. 3 and 6 it can be seen that each of the channels 46 comprise three concentric part cylindrical portions of different diameter. The part cylindrical portion of the forward terminal receiving portion 52 formed in part by the lip 68 has a diameter which is substantially equal to that of the cylindrical female terminals 26 attached to the bared conductor cores 28 so that the cylindrical female terminals 26 are snuggly disposed therein. The length of the cylindrical female terminals 26 is also substantially equal to that of the forward terminal receiving portions 52 of the channels 46 plus that of the transverse rear slots 62. Consequently each of the cylindrical female terminals 26 is substantially immovable with respect to the insert 22 once it has been inserted into a channel via the lateral opening 48 by laterally forcing it into the forward terminal receiving portion 52 of the channel and snapping it past the retaining lip 68 at the free end of the laterally deflectable wall 66.

The diameter of the part cylindrical portions of the rearward insulated lead receiving portions 54 is about equal to that of the outer diameter of the separated leads 30 so that an insulated portion of the separated lead 30 may be received therein in longitudinal alignment with the cylindrical female terminal attached thereto as shown in FIG. 1. The part cylindrical portions defined by the transverse yoke walls 50 are large enough to accommodate the bared conductor core 28 but small enough to provide a forward facing shoulder to adequately restrain the cylindrical female terminal 26 against rearward movement.

The connector 20 is made in the following manner. The end portion of the jacket 32 of the multilead cable 34 is stripped away providing a plurality of separated leads 30 which in turn are partially stripped to provide uninsulated conductor core ends 28. Next the cylindrical female terminals which in this instance merely comprise seamless tubes of the proper length and diameter are then fitted over the uninsulated conductor core ends 28 and suitably secured thereto such as by swaging the end of the tube at a plurality of circumferentially spaced locations. The cylindrical female terminals 26 are then laterally inserted into the terminal receiving portions 52 of the channels 46 where they are securely retained against any appreciable movement in the axial as well as the lateral direction. It should also be noted that insulated portions of the separated leads 30 are disposed in the rear insulated lead receiving portions 54 of the channels 46. Consequently the electrically conductive cores 28 as well as the terminals 26 themselves are well insulated from each other and well protected against accidental contact during subsequent handling. In view of this feature and the secure retention of the terminals an electrical check for the integrity of the connections between the terminals 26 and the conductor cores 18 can advantageously be made at this time if desired. After the terminals 26 and separated leads 30 have been attached to the insert 22 as described above, the insert 22, the assembly and an adjacent end portion of the cable 34 having the common insulator jacket 32 are then placed in a mold (not shown). The mold has portions which mask the front portion of the face plate 40 so that it is exposed in the final product. The mold also has probes which plug the forward open ends of the cylindrical female terminals 26 so that material does not enter the cylindrical female terminals during the molding operation. The molded insulator body 24 is then molded and cured in a conventional manner to the shape shown in FIG. 1. It is preferable that the molded insulator body 24 be molded in such a manner that there are no voids or air pockets and all the unoccupied portions of the inserts 22 are filled with material except of course for the apertures 44 and slot 66. The material of the molded insulator body 24 is preferably matched with that of the cable jacket 32 so that the molded body 24 hermetically seals to the cable jacket 32 during the curing process. As noted previously the exposed front portion of the face plate 40 provides a suitably stiff structure for indexing means and guide means such as the radial index slot 66 and the conical guide surfaces of the apertures 44 when a relatively pliable insulating material is used for the body 24.

We wish it to be understood that we do not desire to be limited to the exact details of construction shown and described, for obvious modifications will occur to a person skilled in the art.

What is claimed is:

1. A preformed insert of insulating material for a molded electrical connector comprising:

a front plate having a plurality of spaced apertures extending therethrough, an elongated turret attached to a rearward face of the front plate and disposed normal thereto, said elongated turret having a plurality of spaced channels, each aligned with a respective aperture, each of said channels having a lateral opening at the periphery of the turret which extends the length of the channel for laterally receiving an electrical terminal attached to the bared conductor of an insulated electrical lead, each of said channels having a transverse yoke wall spaced from said front plate to define a terminal receiving portion in said channel, and each of said terminal receiving portions of said channels being defined in part by a resiliently deflectable wall of the turret having a retention lip at a free end thereof for laterally retaining an electrical terminal snapped therepast into the terminal receiving portion of the channel.

2. The preformed insert defined in claim 1 in combination with a multilead electrical cable having a plurality of spaced insulated conductive cores in a common jacket of pliable molded synthetic insulating material, a plurality of separated leads comprising individually insulated conductive cores at an end of the jacket, and bared conductor core end portions at the ends of the separated leads, a terminal attached to one of said conductor end portions retained in each of said terminal receiving portions of said channels, and a molded body of insulating material enveloping said insert rearwardly of said face plate, the separated leads and an end portion of said jacket adjacent the separated leads.

3. A preformed insert of insulating material for a molded electrical connector comprising:

a front plate having a plurality of spaced apertures extending therethorugh, an elongated turret attached to a rearward face of the front plate and disposed normal thereto, said elongated turret having a plurality of spaced channels, each aligned with a respective aperture, each of said channels extending the entire length of the turret and having a lateral opening at the periphery of the turret which extends the entire length thereof for laterally receiving an electrical terminal attached to the bared conductor of an insulated electrical lead, each of said channels having a transverse yoke wall dividing the channel into a forward terminal receiving portion and a rearward insulated lead receiving portion, and each of said terminal receiving portions of said channels being defined in part by a resiliently deflectable wall of the turret having a retention lip at a free end thereof for laterally retaining an electrical terminal snapped therepast into the terminal receiving portion of the channel.

4. The preformed insert defined in claim 3 in combination with a multilead electrical cable having a plurality of spaced insulated conductive cores in a common jacket of pliable molded synthetic insulating material, a plurality of separated lead comprising individually insulated conductive cores at an end of the jacket, and bared conductor core end portions at the ends of the separated leads, a terminal attached to one of said conductor end portions retained in each of said terminal receiving portions of said channels, and a molded body of insulating material enveloping said insert rearwardly of said face plate, the separated leads and an end portion of said jacket adjacent the separated leads.

5. A unitary preformed insert of moldable insulating material for a molded electrical connector comprising:

a front plate having a plurality of spaced apertures extending therethrough, an elongated turret attached to a rearward face of the front plate and disposed normal thereto, said elongated turret having a plurality of spaced channels, each aligned with a respective aperture, each of said channels extending the entire length of the turret and having a lateral opening at the periphery of the turret which extends the entire length thereof for laterally receiving an electrical terminal attached to the bared conductor of an insulated electrical lead, each of said channels having a transverse yoke wall dividing the channel into a forward terminal receiving portion and a rearward insulated lead receiving portion, and each of said terminal receiving portions of said channels being defined in part by a longitudinal wall of the turret which is separated from said front plate and from the yoke wall of its associated channel by a pair of longitudinally spaced lateral slots so that the longitudinal wall is resiliently deflectable in the lateral direction, each of said channels having a retention lip at a free end thereof for laterally retaining an electrical terminal snapped therepast into the terminal receiving portion of the channel, and each of said yoke walls being for retaining the electrical terminal in the longitudinal direction in cooperation with the front plate.

6. The preformed insert defined in claim 5 in combination with a multilead electrical cable having a plurality of spaced insulated conductive cores in a common jacket of pliable molded synthetic insulating material, a plurality of separated leads comprising individually insulated conductive cores at an end of the jacket, and bared conductor core end portions at the ends of the separated leads, a terminal comprising a cylindrical portion attached to each of said conductor end portions each of said cylindrical portion being retained in one of said terminal receiving portions of said channels with an insulated portion of the separated lead disposed in the insulated lead receiving portion of the channel, and a molded body of insulating material enveloping said insert rearwardly of said face plate, the separated leads and an end portion of said jacket adjacent the separated leads.

* * * * *

UNITED STATES PATENT AND TRADEMARK OFFICE

CERTIFICATE OF CORRECTION

PATENT NO. : 4,043,630

DATED : August 23, 1977

INVENTOR(S) : Lyle B. Suverison and William R. Beck

It is certified that error appears in the above-identified patent and that said Letters Patent are hereby corrected as shown below:

Column 1, line 11, "performed" should read -- preformed --.

Column 3, line 56, "inserts" should read -- insert --.

Column 4, line 44, "therethorugh" should read -- therethrough --.

Column 5, line 1, "lead" should read -- leads --.

Column 6, line 23, "portion" should read -- portions --.

Signed and Sealed this

*Third* Day of *October 1978*

[SEAL]

*Attest:*

RUTH C. MASON
*Attesting Officer*

DONALD W. BANNER
*Commissioner of Patents and Trademarks*